US008522800B2

(12) United States Patent
Parker

(10) Patent No.: US 8,522,800 B2
(45) Date of Patent: Sep. 3, 2013

(54) TILE CLEANUP APPARATUS

(76) Inventor: Rob Parker, Panama City, FL (US)

( * ) Notice: Subject to any disclaimer, the term of this patent is extended or adjusted under 35 U.S.C. 154(b) by 801 days.

(21) Appl. No.: 12/648,914

(22) Filed: Dec. 29, 2009

(65) Prior Publication Data

US 2011/0155183 A1 Jun. 30, 2011

(51) Int. Cl.
*B08B 3/00* (2006.01)

(52) U.S. Cl.
USPC ..... 134/60; 4/541.1; 4/650; 4/653; 206/515

(58) Field of Classification Search
CPC ..... B65H 75/34; B65H 75/36; A01G 9/028; A01G 27/02; A47L 13/50; B44D 3/00; B44D 3/006; A45D 19/10; A61M 3/0287; B67D 7/40; F16L 3/26; F16L 3/003; F16L 3/1226; A62C 33/04
USPC ..... 134/60; 4/541.1, 653; 47/65.6; 248/79; 211/126.7
See application file for complete search history.

(56) References Cited

U.S. PATENT DOCUMENTS

| | | | | | |
|---|---|---|---|---|---|
| 3,490,081 | A | | 1/1970 | Ogden | |
| 3,735,545 | A | | 5/1973 | Bennett | |
| 3,823,905 | A | * | 7/1974 | Ray | 248/87 |
| 3,969,777 | A | | 7/1976 | Beller | |
| 4,173,097 | A | * | 11/1979 | Staby | 47/65.5 |
| 4,318,519 | A | * | 3/1982 | Blevins | 248/79 |
| 4,551,869 | A | * | 11/1985 | Whitney | 4/592 |
| 4,751,763 | A | | 6/1988 | Rose et al. | |
| 4,865,782 | A | | 9/1989 | Paul | |
| 5,267,969 | A | * | 12/1993 | Hirsch et al. | 604/174 |
| 5,428,849 | A | * | 7/1995 | Watkins et al. | 4/541.1 |
| 5,566,706 | A | | 10/1996 | Harpenau | |
| 6,327,721 | B1 | * | 12/2001 | Devereaux et al. | 4/541.3 |
| 6,409,223 | B1 | * | 6/2002 | Bartholoma | 285/114 |
| 7,406,739 | B2 | | 8/2008 | Guest et al. | |
| 7,520,478 | B2 | | 4/2009 | Whitfield | |
| 2002/0194670 | A1 | * | 12/2002 | Hashemi | 4/213 |

OTHER PUBLICATIONS http://www.troxellusa.com/Topics/GroutCaddy/index.aspx plastic bucket with mounted stainless steel squeeze rollers.
http://www.karldahm.com/Ishop2,showdetail,1257364603-12231,e,1257364603-12231,1085813669.1093939120,10398,,Tshowrub--1085813669.1093939120,.htm big plastic bucket on metal frame with wheels. Some type of press mounted on bucket.

* cited by examiner

*Primary Examiner* — Michael Kornakov
*Assistant Examiner* — Marc Lorenzi
(74) *Attorney, Agent, or Firm* — F. Rhett Brockington

(57) ABSTRACT

The invention in one variation is a specialized tub-like apparatus for cleaning sponges. The apparatus is nestable and can be seated in the mouth of a bucket. The apparatus has a ribbed flat bottom, a flanged quasi-circuline tapered side wall contiguous with a pair of elevated shelves with level control holes that establish the water level and flow rate, and a garden hose fastening element that includes two wedged shaped holes that are orthogonal. There is an indentation with drain holes in the center bottom that disburses flow of the incoming water outwardly. The apparatus has a second inward deviation that provides an access port to the interior of the bucket. The access port is large enough to accommodate a drain line for the bucket and wiring. The bottom has several tapered legs with annular drain holes that enable the apparatus to drain dry.

17 Claims, 6 Drawing Sheets

TILE CLEANUP APPARATUS

BACKGROUND OF THE INVENTION

1. Field of the Invention

The present invention relates generally to apparatus for manual cleaning, and in particular to an apparatus that effectuates cleaning a sponge and similar absorbent materials that can be heavily soiled with dust, mud and contaminates, as in the case of installing and maintaining tile and the like.

2. Prior Art

The process of laying tile requires multiple steps, each step typically requiring a cleanup, and therefore cleaning the tile is a substantial part of the overall total work load for the process. Prior to laying the tile clean up is required if the substrate on which the tile is to be laid needs to be prepped. Prepping can include mechanical grinding to achieve adequate flatness. Cleanup of the dust generated from the grinding process is a nuisance and potentially produces a hazardous dust, as the formed dust is normally derived from concrete, which in addition to being an irritant to a worker's lungs, the dust also usually contains silica, where crystalline is a listed carcinogen. There is another cleanup after applying the tile mud (or tile mortar) on the substrate and placing the tiles on it. This step normally is the "least messy" of the steps, but invariably some cleanup is required. For instance, the tile mud/mortar usually ends up on the face of the tile from handling the tile, and this has to be removed. Cleanup is much easier and more effective before the mud has time to cure. Curing normally takes about 24 hours. After curing, tile grout can then be filled in between the tiles in the grout groove. A common method of grouting is to dump a large pile of grout on the tiles and then squeegee the grout into the grooves. While quick, this method covers substantially the entire tile face leaving a residue of grout and (and potentially some mud), which must then be wiped clean. The cleanup is typically manual, where the worker uses a water absorbent material, such as a sponge, a towel or cloth. Normally the water absorbent material is damp, as the presence of in situ water softens the absorbent material, making it a more effective wipe and initially a faster absorbing material for the residue. Water is attracted to water, and the in situ water dilutes the grout, which is typically water based, where the dilution makes the residual grout easier to remove. The effectiveness of the absorbent material decreases as the diluted water based grout permeates and coats the absorbent material because there is less dilution, less absorbency, and the in situ water is about as contaminated with grout as the residue on the tile.

The prior art includes inventions that enhance the efficacy of using wringers to express the in situ water from the absorbent material. Ironically, a wringer which can leave the absorbent material with less in situ water is not necessarily more effective at cleaning up grout and mud, because the absorbent material is drier and the collected contaminating grout and mud are less diluted with situ water. The mixture of in situ water and grout approaches the same composition in the absorbent material as the composition of grout in the residue on the tiles. Cleaning is not improved if the absorbent material is as dirty as the residue, as wiping just smears around the grout. The prior art also teaches the use of large vats mounted on wheels to make the transportation of larger amounts of water more efficient. The use of wheeled vats poses a weight problem, especially on tile that is being grouted. The weight of the wheeled vats can be sufficient to dislodge or move the tile being installed. Planks can be utilized to distribute the weight of the vats, but laying planks requires additional work.

Without the use of vats multiple smaller quantities of clean water must be brought to the job site to have sufficient clean water on hand to wipe the tile down so that the face is free of grout, mud and other contaminates. Tile mud and grout are easiest to cleanup while they are still free flowing, and this only occurs if the grout and mud have not had time to cure. The cure rate in essence establishes a window of time for the cleanup.

SUMMARY OF THE INVENTION

The invention is an apparatus that operationally enables a worker to manually quickly clean a sponge, where a sponge is herein defined to include sponges, other water absorbent materials such as fabrics, brushes and devices comprised of water absorbent materials such as a mop; where the sponge is utilized to clean tile, stone or brick. The invented apparatus is especially efficacious for the process of cleaning a dirty sponge soiled with extraneous grout, cementitious mud, dust, contaminates, chemicals such as coatings and cleaning compounds, and sanitation matter such as pests, mold, mildew, food, bacteria, urine and feces (collectively referred to as detritus) from tile, stone, brick and substrate (collectively referred to as tile). In one variation the invention is a specialized tub-like apparatus, the apparatus is appropriately sized so that it is capable of fitting in the mouth of a bucket, such as a standard five gallon bucket, or in the absence of a bucket, in a sink, on a supporting surface, or in a basin. The bucket is utilized as a collection point for waste water, where waste water is defined as any water flowing into the bucket from the specialized tub-like apparatus. The bucket typically can be fitted with a drain line which, as needed, removes collected waste water from the bucket, either by siphoning off or pumping out the waste water. The specialized tub-like apparatus has a substantially flat bottom that is ribbed, where the ribbing adds structural strength to the bottom and focuses pressure applied to a sponge on the ribbing. The focused pressure facilitates expressing the contents of the sponge. The specialized tub-like apparatus has a replenished level of incoming clean water, which flushes away dirty water, so that a dirty sponge, one loaded with detritus, is cleansed with substantially clean water, making the process of cleaning the dirty sponge much more efficacious than a process that uses a mixture of dirty water and clean water. Incoming clean water is substantially continuously replenished to a desired level and at a controlled rate. Even with a constant incoming flow rate there can be a temporary change in the water level because, in part, when the sponge is squeezed emptying the contents into the apparatus or pressed on the ribbing, the expressed contents can cause a temporary increase in the water level, which produces an increase in head pressure of the water in the apparatus. The increased head pressure causes the water in the apparatus to flow out more quickly through the holes that drain the specialized tub-like apparatus until equilibrium is reestablished. The flow rate of the incoming clean water is established to be sufficient that the dirty water and any extraneous cleanup detritus and particulates are purged from the sponge and out of the apparatus as waste water. The incoming clean water is distributed so that much of it flows substantially between the ribs. The flow rate is adjusted to accommodate for the expected demand on the apparatus. The more workers using the apparatus, generally the higher the demand and the higher the flow rate.

In a preferred variation the specialized tub-like apparatus has a quasi-circuline side wall extending substantially upward and contiguous from a shelf that is elevated and contiguous with most of a perimeter of the bottom. A first shelf has a first level control hole which is an outlet for water in the apparatus, and it functions as one of several control elements for the water level in the apparatus. At least a portion of an upper edge of the side wall is flanged, where the flange has a width, such that the flange extends beyond a diameter of a mouth of the bucket, thus securing the apparatus in the mouth of the bucket. The side wall has at least one deviation. Formed in a first inward deviation of the side wall is a novel hose fastening element that includes a restraining wall with two wedged shaped holes that are substantially orthogonal to each other. The restraining wall provides strength to the quasi-circuline side wall and the bottom. The shape and relative positioning of the wedged shaped holes enable a water hose to be secured without any auxiliary fastening elements. Operationally, a conventional water hose is threaded through a top wedged shaped hole and flexed to curve through a side wedged shaped hole, the combination of these holes causing the water hose to be wedged in place, such that an end of the water hose exits proximate to an indentation in the bottom.

The indentation serves several functions. In one function it disburses flow of the incoming clean water exiting from the end of the water hose. In a second function the indentation also adds strength to the bottom, as the indentation has wall elements that are substantially orthogonal to the bottom. In one variation the indentation has a sloped floor and a tapered block shape, which functions to fan out the flow so that much of the water flows from the indentation near a center of the ribbed bottom approximately outwardly across the ribbed bottom. In another variation the apparatus has a second inward deviation of the quasi-circuline side wall where the second inward deviation curves forming a substantially serpentine loop. The loop provides an access port to a point below the bottom of the apparatus, for example for drain lines and wires to the interior of the bucket. The access port is large enough to accommodate the drain line and wiring. The second deviation is preferably approximately opposite the first deviation, and it also provides rigidity to the apparatus.

The rate of water flow can be controlled by numerous methods (valve at hose end, valve at hose beginning, etc). As the incoming clean water enters the apparatus, the water level rises until it encounters the shelf having the first level control hole. In one variation of the invention there are a plurality of shelves and a plurality of level control holes. The level control holes are sized appropriately to allow a wide range of water flow to occur before drainage from the apparatus is not as fast as the flow rate of the incoming clean water. When the flow rate of the incoming clean water exceeds drainage eventually the level control holes will be overcome causing the apparatus to overflow. When the water level reaches the level control holes, the water flow rate is adjusted to match the amount of water that is required to meet the cleaning demands. Rinse time should be fast enough that workers are not standing around waiting to clean their sponge. Extra sponges can be on hand to handle surges. In one variation of the invention the quasi-circuline side wall is marked with indices corresponding to a known flow rate. The indices also make it easy to determine if equilibrium has been reached. Furthermore, a user can coordinate a mark on the indices with a demand, in part to conserve the use of water.

In another variation, the invention has legs depending from the underside of the bottom. The legs are particularly useful when the apparatus is used in a sink. Each leg preferably has a tapered annular drain hole through which detritus, precipitates and waste water can exit. A plurality of annular drain holes work in unison to remove heavier detritus.

The indentation can have a indentation drain hole or a plurality of indentation drain holes. The leg drain holes and the indentation drain holes work in combination as outlets that allow the apparatus to drain substantially dry when there is no incoming clean water. The combination of drain holes also function as outlets for detritus and precipitates that are too heavy to be conveyed to the level control holes, which are higher. Typically, the drain holes are located at the lowest point in the legs and of the indention.

BRIEF DESCRIPTION OF THE DRAWINGS

The foregoing invention will become readily apparent by referring to the following detailed description and the appended drawings in which.

DETAILED DESCRIPTION OF THE INVENTION

The illustrated invention is a specialized tub-like apparatus, where the tub-like apparatus in one application is employed as a tile cleanup apparatus for cleaning a sponge soiled with detritus collected during the preparation of the substrate, the installation and the maintenance of the tile. The reader is reminded that the term "detritus" collectively includes extraneous grout, cementitious mud, dust, contaminates, chemicals such as coatings and cleaning compounds, and sanitation matter such as pests, mold, mildew, food, bacteria, urine and feces; that the term "tile" collectively includes tile, stone, brick and substrate; and that the term "sponge" collectively includes sponges, other water absorbent materials such as fabrics, brushes, and devices comprised of water absorbent materials such as a mop.

The utility of the invention is that it enables a worker to manually quickly clean a dirty sponge soiled with detritus from cleaning tile. The specialized tub has a replenished level of incoming clean water which flushes away the detritus. In one embodiment the specialized tub-like apparatus is a molded integral piece that includes a novel hose fastening element having a restraining wall with two wedged shaped holes that are substantially orthogonal to each other. The specialized tub-like apparatus also has an indention that fans out a stream of incoming clean water, and the indention drains off detritus and precipitates removed from the sponge to a collection point for waste water, keeping the apparatus substantially free of the buildup of detritus and heavy precipitates displaced from the sponges. Drainage continues until the specialized tub-like apparatus is substantially dry.

Figure 1:
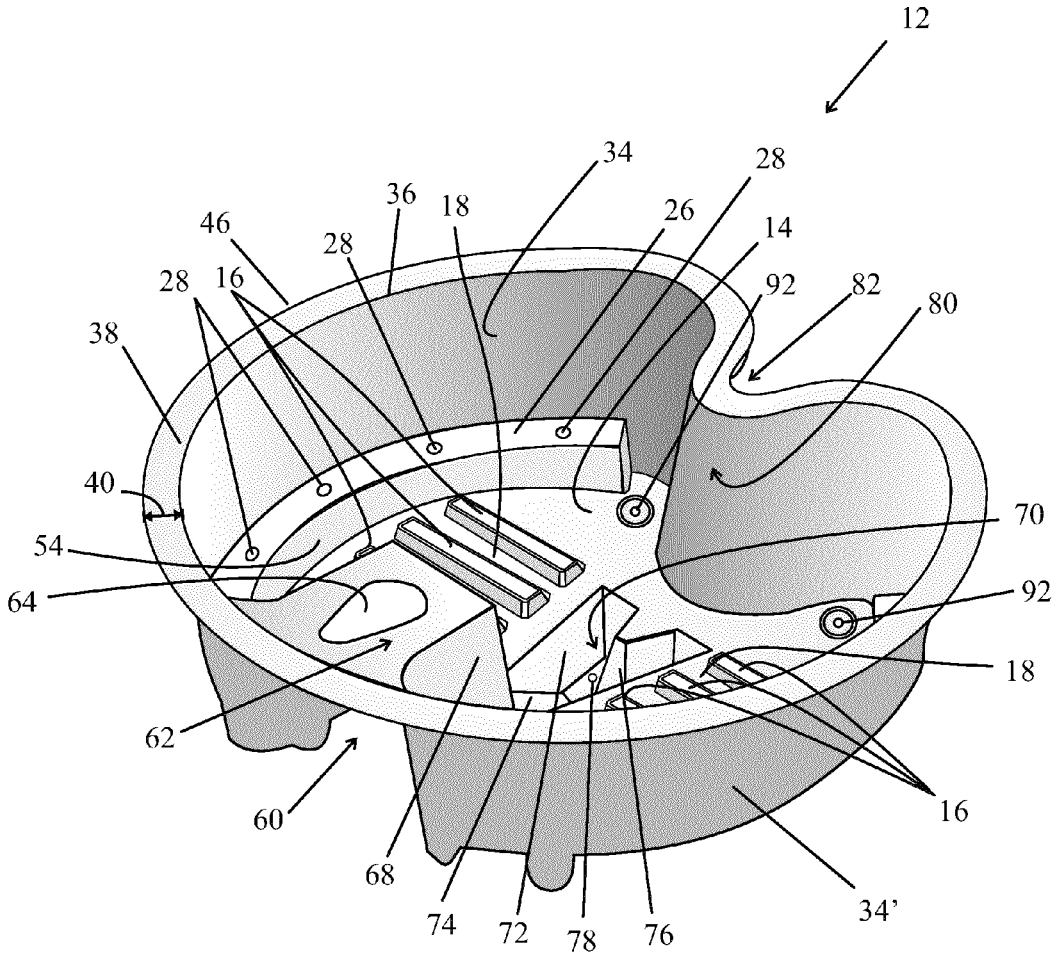
FIG. 1 is a perspective overhead view of a specialized tub-like apparatus, which is utilized as a tile cleanup apparatus for cleaning sponges soiled with detritus, where the detritus is collected during the preparation of the substrate, the installation and the maintenance of tile.
Figure 2:
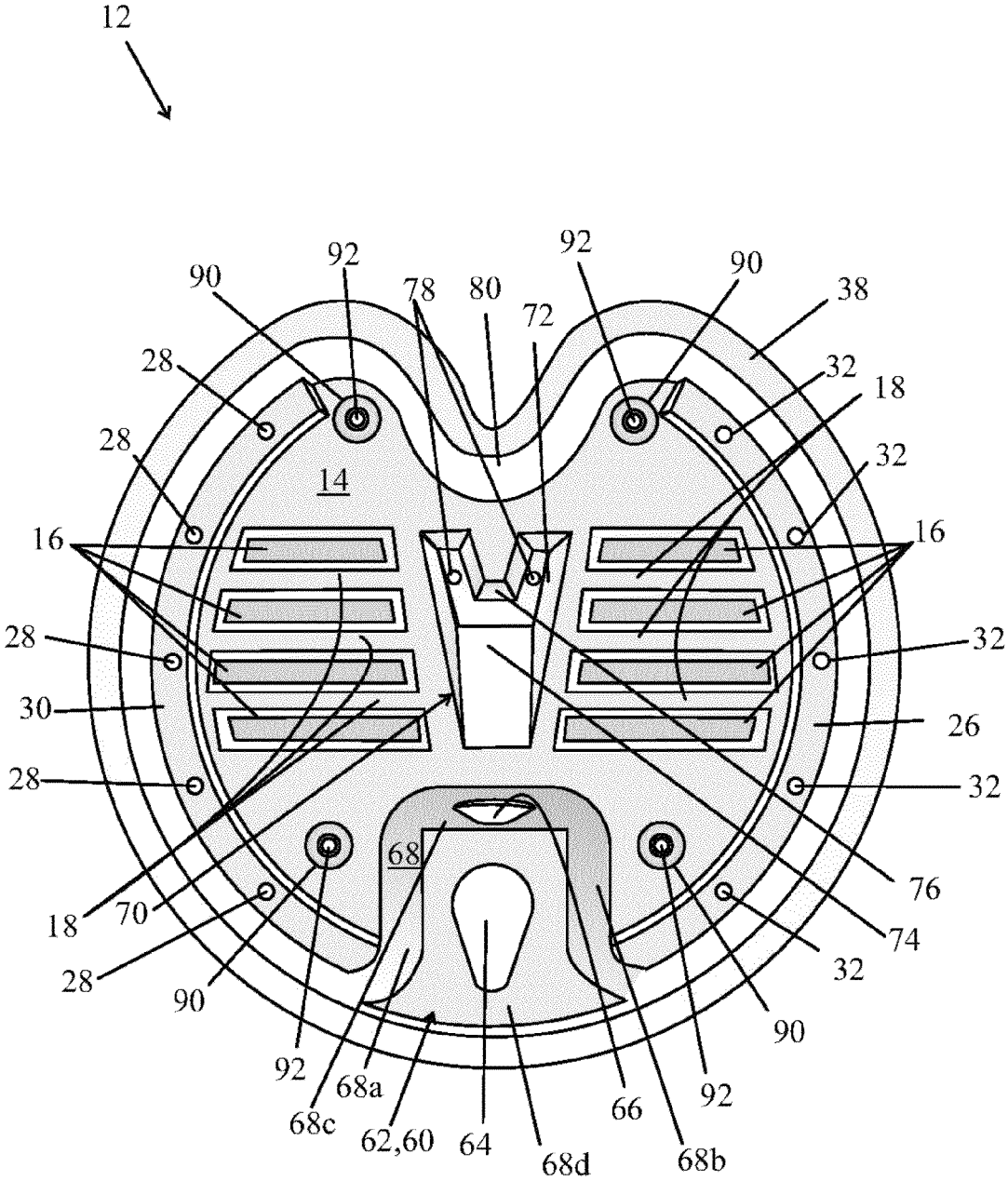
FIG. 2 is a top planar view of the specialized tub-like apparatus illustrated in FIG. 1.
Figure 7:
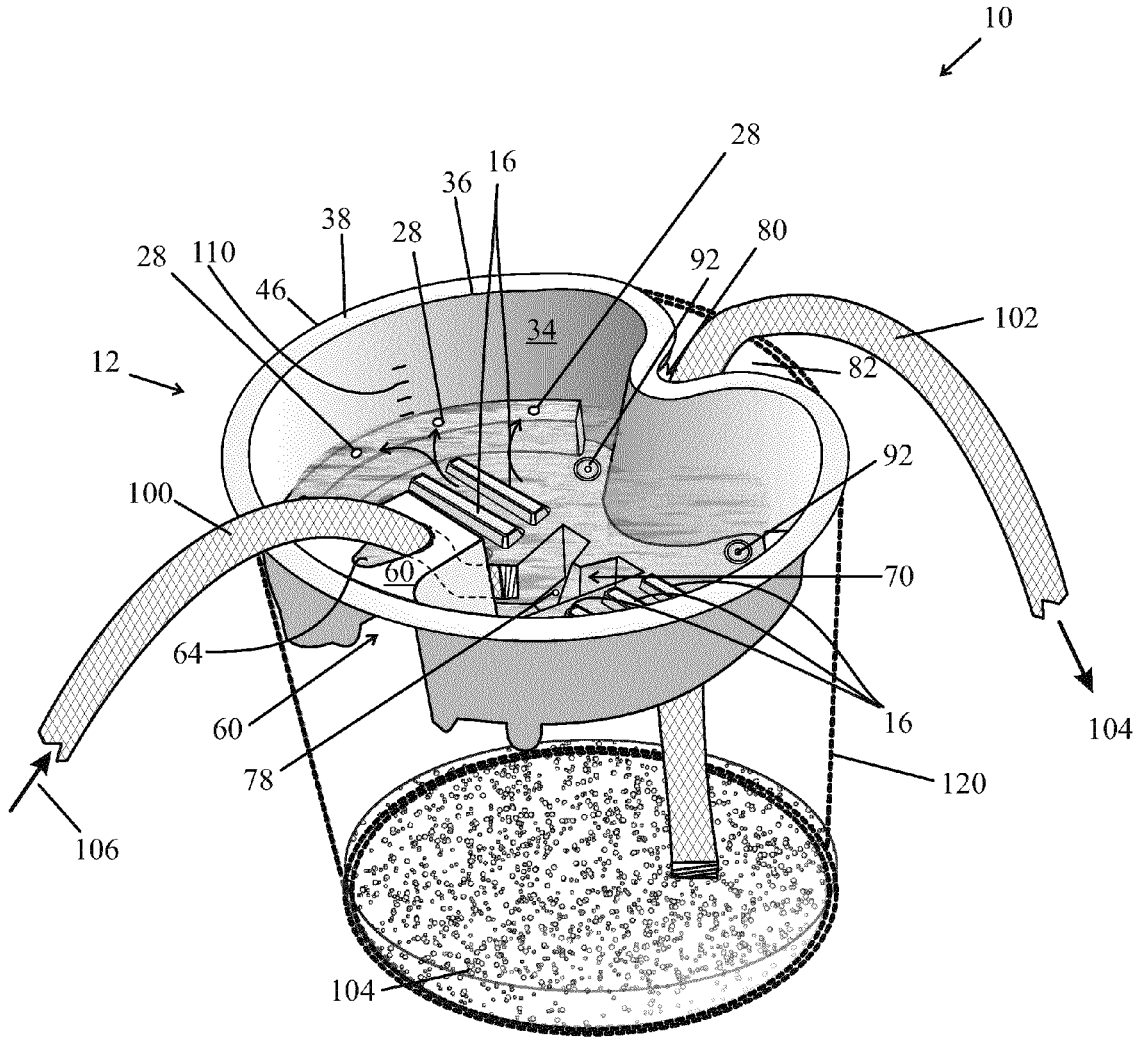
FIG. 7 is a perspective overhead view of the specialized tub-like apparatus seated in the mouth of a bucket, where the tub-like apparatus is hooked up to a water hose bringing in clean water and the bucket is being emptied by a drain hose conveying away waste water containing detritus from soiled sponges that were used to clean tile.

Referring to FIG. 1, which is a perspective overhead view of the specialized tub-like apparatus 12, and FIG. 7 where the tub-like apparatus 12 is being utilized as a tile cleanup apparatus 10 seated in a bucket 120, the specialized tub-like apparatus 12 operationally is typically partially filled with a replenished level of clean water that flows approximately outwardly towards the quasi-circuline side wall 34. The quasi-circuline side wall 34 extends substantially upward and contiguous from a first shelf 26 on a first riser 54. The first riser 54 is contiguous with a portion of a perimeter of a flat bottom 14 that has tapered ribs. The first shelf 26 has at least one first level control hole 28, and as illustrated in FIG. 1 the first shelf 26 has a plurality of first level control holes 28, where four holes 28 are visible and, accordingly, similarly numbered. In a preferred variation of the specialized tub-like apparatus 12, as illustrated in FIG. 2, (but not visible in FIG. 1 and FIG. 7) the tub-like apparatus 12 is symmetrical with respect to the shelf and tapered ribs, and there is a second shelf 30 with at least one second level control hole 32. The illustrated first level control hole(s) 28 and second level control hole(s) 32 function primarily to set the water level in the specialized tub-like apparatus 12.

Figure 5:
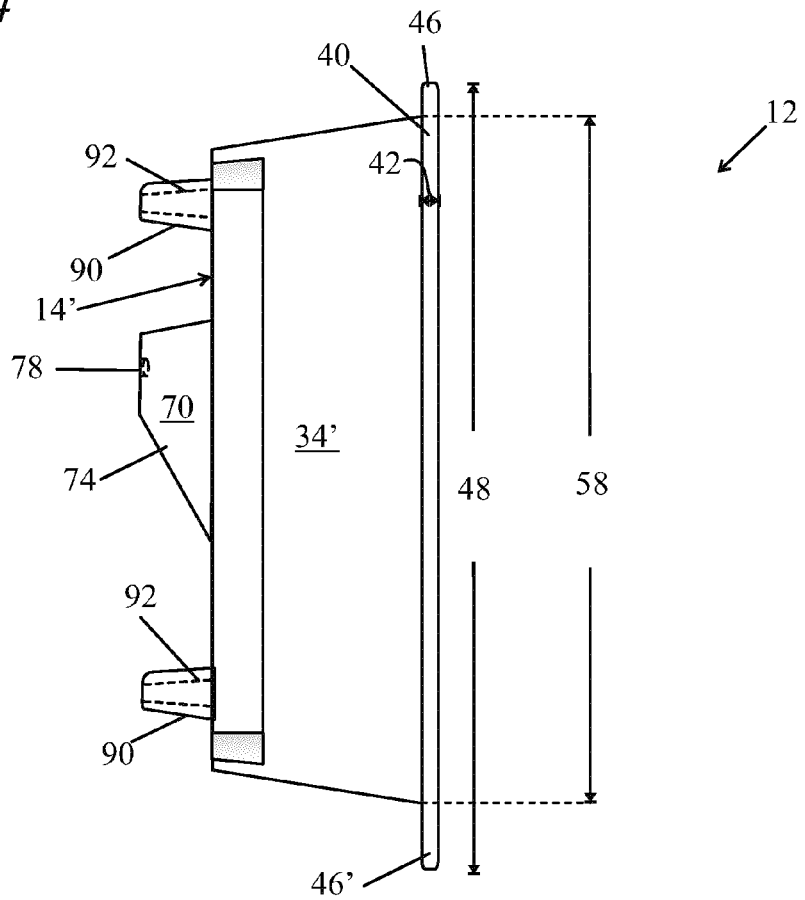
FIG. 5 is a side end-on planar view of the specialized tub-like apparatus illustrated in FIG. 1.

As readily apparent in FIG. 5, which is a side end-on planar view of the specialized tub-like apparatus, the quasi-circuline side wall 34 is tapered from the flange 40 to the bottom 14. The tapering facilitates the ease of de-molding of the integral molded piece of the specialized tub-like apparatus 12. It also makes the specialized tub-like apparatus 12 nestable, so that multiple apparatus can be stored more efficiently (i.e. take up less volume) and shipped at less cost.

Referring again to FIG. 1, at least a portion of the rim 36 of the side wall 34 has a flange 38, where the flange has a width 40, such that the flange extends beyond a diameter of the mouth of the bucket in which the specialized tub-like apparatus is seated. A preferred bucket is a 5 gallon bucket, and its nominal dimensions are about 11¾ top×10⅜ bottom×14½ deep in. As shown in FIG. 5, the overall diameter 48 from one outer edge 46 of the flange 38 to the opposing outer edge 46' would therefore be greater than 11¾ inches for a standard 5 gallon bucket. A diameter 58 of the exterior quasi-circuline side wall 34' would be less than 11¾ inches.

The specialized tub-like apparatus 12 has a plurality of ribs 16 on the bottom 14. The illustrated ribs 16 are substantially parallel and tapered. The ribs add structural strength to the bottom and focuses pressure on the sponge. The focused pressure facilitates expressing the contents of the sponge, because by pressing the sponge down on the ribs the downward force is concentrated producing zones within the sponge that are more highly compressed. The expressed detritus is initially compressed in the channel-like areas 18 between the ribs, and the flow of the clean water through these channel-like areas 18 (also see FIG. 2) carries the detritus to the level control holes and other drain holes. The tapering makes de-molding easier, and therefore faster, as less cooling between molding cycles is required.

Returning to FIG. 7, clean water 106 is flowing into the specialized tub-like apparatus 12 through the clean water hose 100 that is a conventional garden hose. The clean water level is marked by the first of four indices 110. Waste water 104 is collected by the bucket 120 (shown in dashed lines), and is removed from the bucket 120 by the drain line 102. The drain line 102 can be attached to a bulkhead connector (not shown) mounted at the bottom of the bucket. The waste water 104 is gritty with extraneous grout, cementitious mud, and dust. As is evident from viewing FIG. 7 the incoming clean water 106 is substantially continuously replenished to the desired level (depth in the specialized tub-like apparatus 12), the water flowing from the indentation 70 in the bottom outwardly over and between the ribs to the shelves 26,30 (see FIG. 2), and then exiting through the plurality of flow control holes 28,32.

Figure 4:
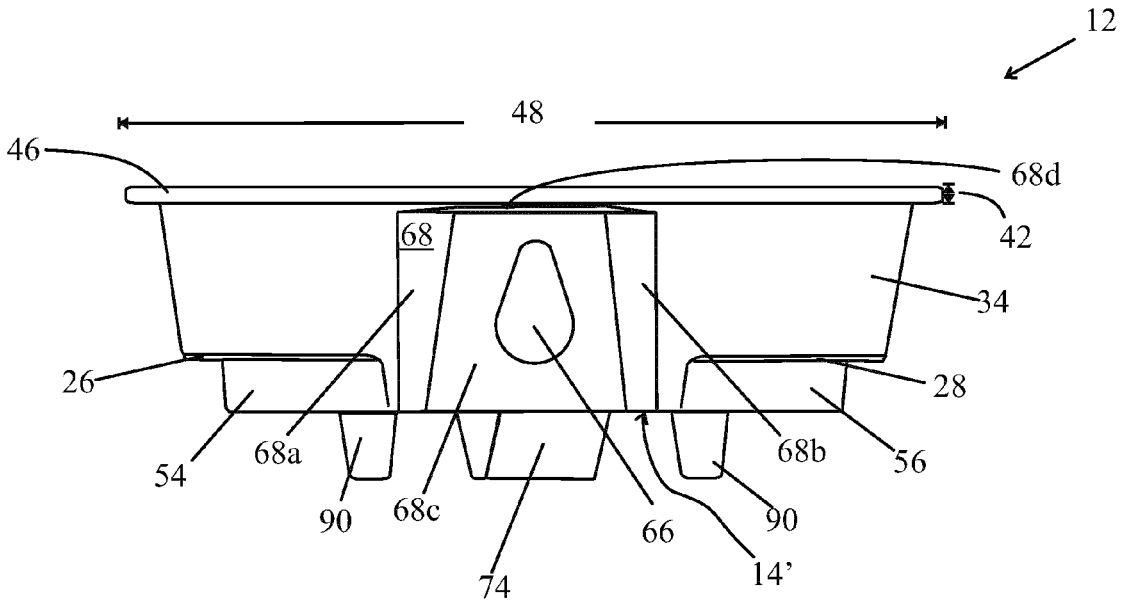
FIG. 4 is a frontal planar view of the specialized tub-like apparatus illustrated in FIG. 1.
Figure 6:
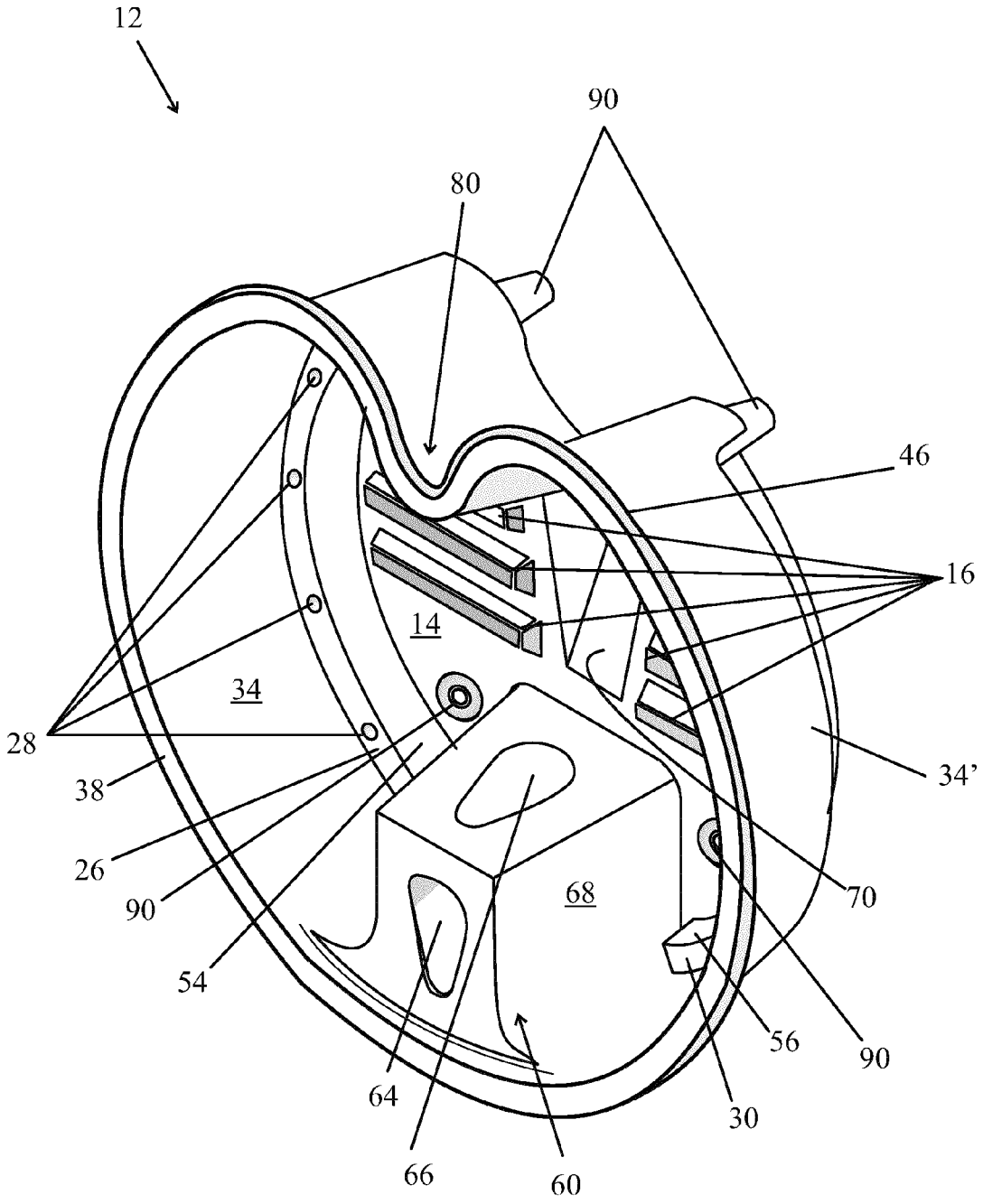
FIG. 6 is a perspective overhead end-on top view of the specialized tub-like apparatus illustrated in FIG. 1.

The quasi-circuline side wall 34 of the specialized tub-like apparatus 12, as shown in FIG. 4 and FIG. 6, has at least one deviation, where the wall deviates inward. The first inward deviation 60 of the side wall is a novel hose fastening element 62 having a restraining wall 68 with two wedged shaped holes, a top wedged shaped hole 64 and a side wedged shaped hole 66, that are substantially orthogonal to each other. The restraining wall 68 has a number of wall sections. As indicated in FIG. 4 the restraining wall sections include a left wall section 68*a*, a right side wall section 68*b*, an indented wall section 68*c*, and a top wall section 68*d*. The wall sections provide strength to the quasi-circuline side wall and the bottom. The shape and relative positioning of the wedged shaped holes enables the clean water hose 100 to be secured without any auxiliary fastening elements. Operationally, as shown in FIG. 7 a conventional water hose is threaded through the top wedged shaped hole 64 in the top wall section 68d and flexed to curve through the side wedged shaped hole 66 in the indented wall section 68*c*, the combination of these holes causing the water hose to be wedged in place, such that an end of the water hose exits proximate to an indentation 70 in the bottom 14. The indentation 70 disburses the incoming clean water from the clean water hose 100 adds strength to the bottom. The indentation, as shown in FIG. 2, has lateral walls 72 that are slightly tapered and indented in the bottom 14, and is located approximately in the center of the specialized tub-like apparatus 12, bisecting a pair of parallel rows of ribs 16. The indentation has a sloped floor block "V" shape, which functions to fan out the water flow so that much of the water flows from the indentation near a center of the ribbed bottom outwardly through the channel-like areas 18 across the ribbed bottom. The sloped floor 74 of the indentation is feeds to a center wall 76 of the block "V"shape. The center wall 76 disrupts and splits the flow of the incoming water, and the "V" diverters the water outward from the indention 70. The indentation has an indentation drain hole 78, and in the illustrated embodiment there are a set of indentation drain holes 78. These indentation drain holes are discussed in greater length at a later time.

The specialized tub-like apparatus 12 has a second inward deviation 80 of the quasi-circuline side wall where the second inward deviation curves forming a substantially serpentine loop 82. The loop 82, as illustrated in FIG. 7, provides an access port to a point below the bottom of the apparatus, gaining access to the interior of the bucket 120. The access port is large enough to accommodate the drain line 102 and wiring. The drain line 102 conveys waste water 104. The wiring, for example, may be for the purpose of supplying electrical power to a lift pump (not shown) in the bucket. The lift pump could be actuated by the depth level of waste water 104 in the bucket 120. The second deviation 80 is preferably approximately opposite the first deviation 60, and it also provides rigidity to the apparatus. The second deviation 80 is also tapered for the reasons previously discussed.

Figure 3:
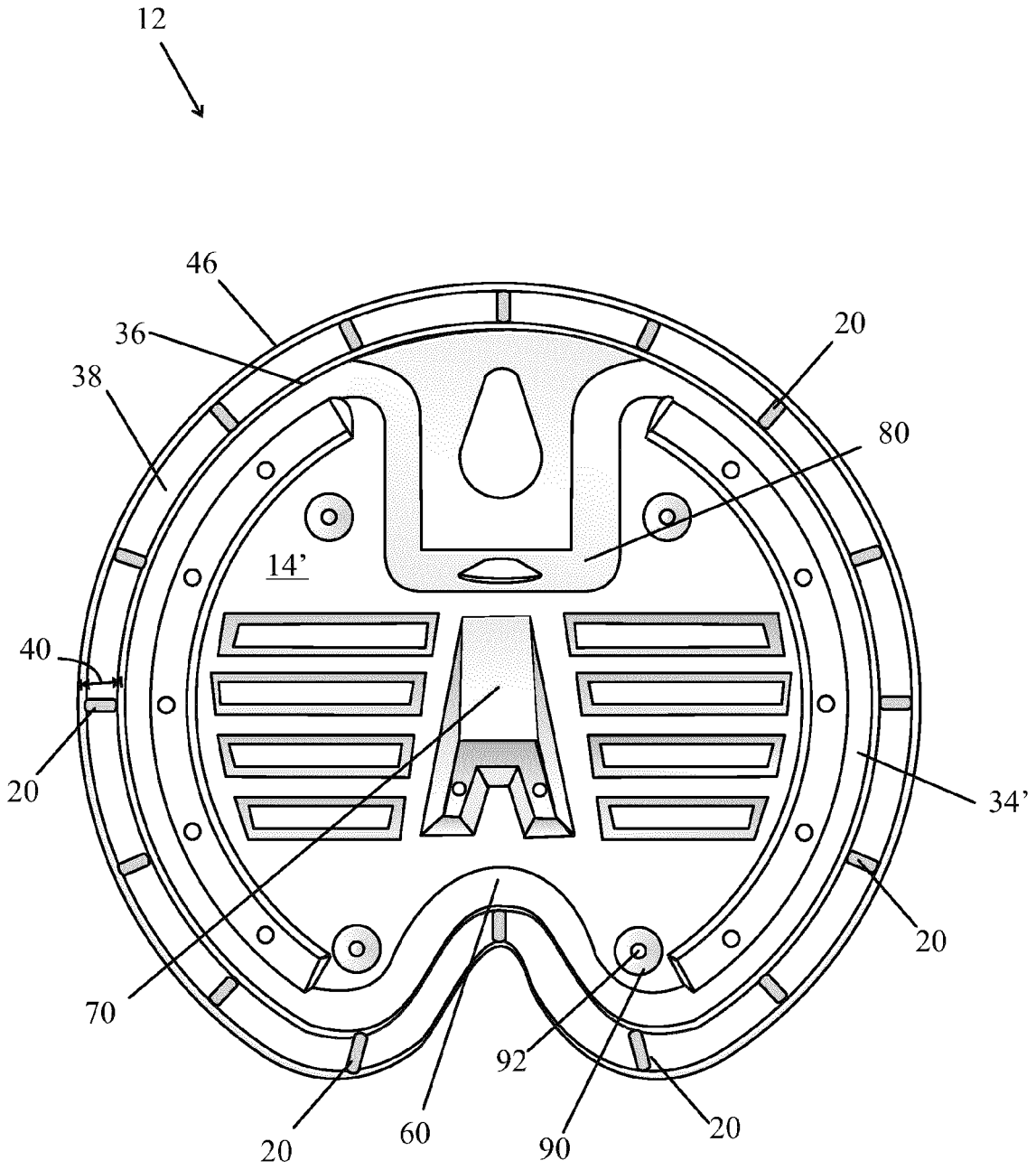
FIG. 3 is a bottom planar view of the specialized tub-like apparatus illustrated in FIG. 1.

FIG. 3, which is a bottom planar view of the specialized tub-like apparatus illustrated in FIGS. 1 and 2, shows that the elements, such as the ribs 16, that are raised in the top view are recessed, and that the indention 70 is raised. Furthermore, the flange 38 is supported on the underside with a series of spokes 20.

FIG. 4 and FIG. 5 illustrate an embodiment where the specialized tub-like apparatus 12 has legs 90 depending from the underside 14' of the bottom 14. The legs 90 are tapered.

The legs are particularly useful when the tub-like apparatus 12 is used in a sink, positioned in a basin or on a surface (not shown). Each leg 90 preferably has a leg drain hole 92, which is substantially a tapered annular passage, through which detritus, precipitates and dirty water can exit. A plurality of leg drain holes drains the entire bottom, except for the indentation 70, which has an indentation drain hole 78. The combination of the leg drain hole(s) 92 and the indentation drain hole(s) 78 will drain the apparatus dry if there is no incoming clean water, making the apparatus largely self-cleaning. The combination also serves as outlets for detritus and precipitates that are too heavy to be conveyed to the level control holes 28,32.

Operationally, the rate of water flow can be controlled by numerous methods (valve on the clean water hose, spigot, etc.). As the incoming clean water enters the apparatus, the water level rises until it encounters the level control hole(s). A minimum flow rate is higher than the flow rate of the combination of drain holes, such that the water level rises to the level control holes on the shelf or shelves. The level control holes are sized appropriately to allow a wide range of water flow to occur before the flow rate of the incoming clean water is fast enough to overcome the total rate of flow through the level control holes, irregardless of the head pressure, therein causing the apparatus to overflow. Typically, the water flow rate is adjusted to match the amount of water that is required to meet the cleaning demands. Rinse time should be fast enough that workers are not standing around waiting to clean their sponge. Extra sponges can be on hand to handle surges. In one variation of the invention the quasi-circuline side wall is marked with indices 110 corresponding to a known flow rate. The indices also make it easy to determine if equilibrium has been reached. Furthermore, a user can coordinate a mark on the indices with the demand, in part to conserve the use of water. The cleaning capacity is the cycle time of the apparatus to clean a sponge, and generally it is preferable slightly higher than the demand. The cleaning capacity can be lengthened if there are excess sponges on hand. A plurality of the specialized tub-like apparatus 12 can be employed to accommodate a higher demand.

In applications where the tub-like apparatus is employed as a tile cleanup apparatus for cleaning a sponge soiled with detritus collected during the installation and maintenance of the tile, the clean water can be premixed with surface active agents, such as soaps, and solvents, such as isopropyl alcohol to enhance the cleaning efficacy of the sponge. Furthermore, the ambient temperature of the incoming clean water can be pre-warmed or pre-cooled to a desired temperature to augment the specialized tub-like apparatus 12 being utilized as a tile cleanup apparatus.

In some cases it is desirable to use the apparatus in a sink. For instance if one is cleaning a countertop, the invention is placed in a proximate sink, and the spigot is turned on. Collection and disposal of the waste water is accomplished by the sink and its associated plumbing.

It is anticipated that the specialized tub-like apparatus 12 can be employed in other applications for example cleaning water based paint and varnishes from rollers and sponge brushes; and cleaning spackling, caulking and joint from spatulas and other tools. The apparatus can also be utilized in maintenance applications, such as the maintenance of tile. Examples include removing cleaning compounds such as grout cleaners and sanitary cleaning where sanitation matter such as pests, mold, mildew, food, bacteria, urine and feces are removed the tile. The apparatus can be used facilitate cleaning shower, counters, bathtubs, floors, backsplashes, and components thereof. The apparatus is also useful in cleaning cars, and in particular those heavily soiled areas like wheels, fenders, and bumpers. In applications where strong cleaning chemicals are used, a mop or brush can be rapidly flushed clean with the apparatus as it has a replenished level of clean water which displaces the detritus.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. A specialized tub-like apparatus for cleaning sponges comprising:

a flat bottom having tapered raised ribs, wherein the ribs provide support to the bottom and focus pressure applied to a pressed sponge therein expressing detritus from a soiled sponge;

a flanged quasi-circuline tapered side wall so dimensioned that the apparatus can be seated in a mouth of a bucket, wherein said side wall is contiguous with and extends above a shelf on a riser that is contiguous with the ribbed bottom, wherein said shelf has a plurality of level control holes that operationally function in part to establish a level of incoming clean water in said apparatus, and also function as an outlet through which detritus, precipitates and water can exit the tub-like apparatus as waste water;

a first inward deviation of the side wall, wherein the side wall deviates inwardly from circuline to linear, said first inward deviation comprising a water hose fastening element that functionally enables a water hose to be reversibly secured to the tub-like apparatus, wherein said water hose fastening element has a restraining wall with a top wedge-shaped hole in a top wall section and a side wedge-shaped hole in an indented wall section, wherein the holes in the top and indented wall sections are substantially orthogonal to each other, wherein the water hose will be restrained as it passes through the top hole and is flexed to curve through the side hole, such that a clean water hose can be fitted to the tub-like apparatus without any auxiliary fastening elements; and an indentation in the bottom, said indentation having tapered lateral walls and a sloped floor that feeds to an indentation drain hole, said indentation drain hole serving as another outlet through which detritus, precipitates and water can exit the tub-like apparatus as waste water, wherein said indentation disburses incoming clean water outwardly towards the tapered side wall, said disbursed incoming clean water displacing water admixed with detritus formed during cleaning.

2. The apparatus according to claim 1 further comprising:

a tapered leg having a tapered annular drain hole, said tapered leg depending from the bottom of the apparatus, wherein the leg elevates the apparatus and said tapered annular drain hole serving as a passage outlet through which detritus, precipitates and water can exit the tub-like apparatus as waste water.

3. The apparatus according to claim 1 further comprising:

a second inward deviation of the side wall forming a serpentine loop that provides an access port to a point below the bottom of the apparatus, for running drain lines and wires to a bucket.

4. The apparatus according to claim 1, wherein said apparatus is an integral molded piece.

5. The apparatus according to claim 1, wherein said apparatus can be nested with another said apparatus.

6. The apparatus according to claim 1, wherein said indentation has a blocked "V"-shape.

7. The apparatus according to claim 1, wherein said flanged quasi-circuline tapered side wall is marked with indices.

8. The apparatus according to claim 3, wherein said apparatus has a pair of shelves, wherein the shelves are separated from each other by the first inward deviation and the second inward deviation.

9. A specialized tub-like apparatus that can be seated in a mouth of a bucket, said apparatus comprising:

a flat bottom having tapered raised ribs, wherein the ribs provide support to the bottom and focus pressure applied to a pressed sponge therein expressing detritus from a soiled sponge;

a flanged quasi-circuline tapered side wall so dimensioned as to enable the apparatus to be seated in the mouth of the bucket, wherein said side wall is contiguous with and extends above both a first shelf on a first riser and an opposing second shelf on a second riser, both first and second shelves being contiguous with the ribbed flat bottom, wherein said first and second shelves have a plurality of level control holes that operationally function in part to establish a level of incoming clean water in the apparatus, and also function as an outlet through which detritus, precipitates and water can exit the tub-like apparatus as waste water;

a first inward deviation of the side wall, wherein the side wall deviates inwardly from circuline to linear, said first inward deviation comprising a water hose fastening element that functionally enables a water hose to be reversibly secured to the tub-like apparatus, wherein said water hose fastening element has a restraining wall with a top wedge-shaped hole in a top wall section and a side wedge-shaped hole in an indented wall section, wherein the holes in the top and indented wall sections are substantially orthogonal to each other, wherein the water hose will be restrained as it passes through the top hole and is flexed to curve through the side hole, such that a clean water hose can be fitted to the tub-like apparatus without any auxiliary fastening elements;

an indentation in the bottom, said indentation having tapered lateral walls and a sloped floor that feeds to an indentation drain hole, said indentation drain hole serving as another outlet through which detritus, precipitates and water can exit the tub-like apparatus as waste water, where said indentation disburses incoming clean water outwardly towards the tapered side wall, said disbursed incoming clean water displacing water admixed with detritus formed during cleaning; and a second inward deviation of the side wall, wherein the side wall deviates inwardly from circuline and forms a serpentine loop that provides an access port to an interior of the bucket to a point below the bottom of the apparatus, for drain lines and wires.

10. The apparatus according to claim 9 further comprising:

a tapered leg having a tapered annular drain hole, said tapered leg depending from the bottom of the apparatus, wherein the leg elevates the bottom and the tapered annular drain hole provides a passage for detritus and water.

11. The apparatus according to claim 9, wherein said apparatus is an integral molded piece.

12. The apparatus according to claim 9, wherein, operationally, said clean water hose is secured to the tub-like apparatus and the clean water hose is conveying clean water at a rate controlled by a flow control valve.

13. The apparatus according to claim 12, wherein said flanged quasi-circuline tapered side wall is marked with indices.

14. The apparatus according to claim 13, wherein said flow control valve is adjustable so that there is a flow rate sufficient to maintain a water level at a desired mark on the indices.

15. The apparatus according to claim 14, wherein said apparatus can be nested with another said apparatus.

16. A specialized tub-like apparatus seated in a sink, said apparatus comprising:

a bottom having tapered raised ribs, wherein the ribs provide support to the bottom and focus pressure applied to a pressed sponge therein expressing detritus from a soiled sponge;

a flanged quasi-circuline tapered side wall so dimensioned that the apparatus can be seated in the sink, wherein said side wall is contiguous with and extends above both a first shelf on a first riser and an opposing second shelf on a second riser, both first and second shelves being contiguous with the ribbed bottom, where said first and second shelves have a plurality of level control holes that operationally function in part to establish a level of incoming clean water in the apparatus, and also function as an outlet through which detritus, precipitates and water can exit the tub-like apparatus as waste water;

a first inward deviation of the side wall, wherein the side wall deviates inwardly from circuline to linear, said first inward deviation comprising a water hose fastening element that functionally enables a water hose to be reversibly secured to the tub-like apparatus wherein said water hose fastening element has a restraining wall with a top wedge-shaped hole in a top wall section and a side wedge-shaped hole in an indented wall section, wherein the holes in the top and indented wall sections are substantially orthogonal to each other;

an indentation in the bottom, said indentation having tapered lateral walls and a sloped floor that feeds to an indentation drain hole, said indentation drain hole serving as another outlet through which detritus, precipitates and water can exit the tub-like apparatus as waste water, wherein said indentation disburses incoming clean water outwardly towards the tapered side wall, said disbursed incoming clean water displacing water admixed with detritus formed during cleaning;

a plurality of tapered legs each having a tapered annular drain hole, said tapered legs depending from the bottom of the apparatus, wherein the legs elevate the apparatus and said tapered annular drain hole serving as a passage through which detritus, precipitates and water can exit the tub-like apparatus as waste water; and a clean water hose conveying clean water secured in the hose fastening element without any auxiliary fastening elements by threading said clean water hose through the to hole and flexing it to curve through the side hole, such that the clean water exits the hose into the indentation, and is disbursed outwardly towards the first shelf and second shelf.

17. The apparatus according to claim 16, wherein said apparatus can be nested with another said apparatus.

* * * * *